US010389038B2

(12) United States Patent
Tuau et al.

(10) Patent No.: US 10,389,038 B2
(45) Date of Patent: Aug. 20, 2019

(54) SUBREFLECTOR OF A DUAL-REFLECTOR ANTENNA

(71) Applicant: Alcatel Lucent, Boulogne Billancourt (FR)

(72) Inventors: Denis Tuau, Trignac (FR); Armel Lebayon, Trignac (FR)

(73) Assignee: Alcatel Lucent, Nozay (FR)

( * ) Notice: Subject to any disclaimer, the term of this patent is extended or adjusted under 35 U.S.C. 154(b) by 597 days.

(21) Appl. No.: 14/374,886

(22) PCT Filed: Jan. 29, 2013

(86) PCT No.: PCT/EP2013/051692
§ 371 (c)(1),
(2) Date: Jul. 25, 2014

(87) PCT Pub. No.: WO2013/113701
PCT Pub. Date: Aug. 8, 2013

(65) Prior Publication Data

US 2014/0368408 A1 Dec. 18, 2014

(30) Foreign Application Priority Data

Jan. 31, 2012 (FR) ..... 12 50895

(51) Int. Cl.
*H01Q 15/14* (2006.01)
*H01Q 19/02* (2006.01)
(Continued)

(52) U.S. Cl.
CPC ..... *H01Q 15/14* (2013.01); *H01Q 19/026* (2013.01); *H01Q 19/134* (2013.01); *H01Q 19/193* (2013.01)

(58) Field of Classification Search
CPC .... H01Q 15/14; H01Q 19/026; H01Q 19/134; H01Q 19/19; H01Q 19/193
See application file for complete search history.

(56) References Cited

U.S. PATENT DOCUMENTS 4,963,878 A * 10/1990 Kildal ..... H01Q 19/134 343/781 P
5,959,590 A * 9/1999 Sanford ..... H01Q 19/021 343/781 CA
(Continued)

FOREIGN PATENT DOCUMENTS

CN 101 976 766 A 2/2011
JP S56 152301 A 11/1981
(Continued)

OTHER PUBLICATIONS

Jian Yang et al., "A New Metal-rod-supported Hat Antenna for Potentially Combining With The Eleven Antenna as a Dual-Band Feed for Reflectors," Proceedings of the 5th European Conference on Antennas and Propagation (EUCAP), IEEE, pp. 763-767, XP031878259, Apr. 11, 2011.
(Continued)

*Primary Examiner* — Daniel Munoz
(74) *Attorney, Agent, or Firm* — Fay Sharpe LLP

(57) ABSTRACT

A subreflector of a dual-reflector antenna comprises a first extremity comprising a convex inner surface, a second extremity adapted for coupling to the extremity of a waveguide, and a body extending between the first extremity and the second extremity. The body comprises a first dielectric part having a portion penetrating into the waveguide and a portion outside the waveguide, and a second metallic part comprising a first cylindrical portion, contiguous with the first extremity of the subreflector, whose diameter is greater than the portion outside the waveguide of the first dielectric part, and a second cylindrical portion, adjacent to the first cylindrical portion, extended by a conical portion that penetrates into the first dielectric part. The first cylindrical portion features a flat ring-shaped surface that forms an
(Continued)

Figure 1:
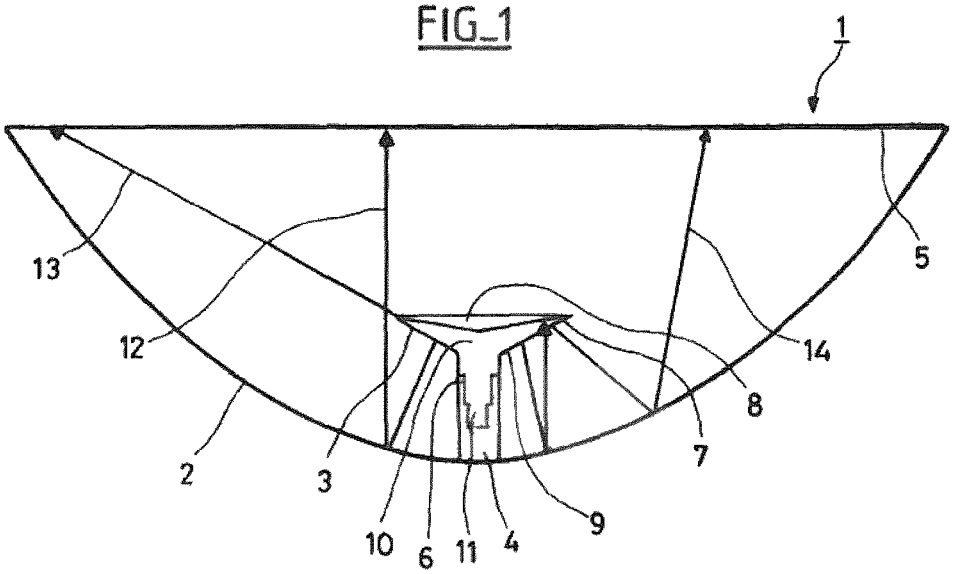

angle less than 90° with the axis of the subreflector so as to face the primary reflector.

13 Claims, 4 Drawing Sheets

(51) Int. Cl.
*H01Q 19/13* (2006.01)
*H01Q 19/19* (2006.01)

(56) References Cited

U.S. PATENT DOCUMENTS 5,973,652 A 10/1999 Sanford et al.
6,724,349 B1 4/2004 Baird et al.
6,919,855 B2 * 7/2005 Hills ..... H01Q 19/193 343/781 CA
2013/0057444 A1 * 3/2013 Brandau ..... H01Q 19/134 343/781 CA

FOREIGN PATENT DOCUMENTS

JP 2-121506 A 5/1990
JP 2007-235564 A 9/2007
JP 2008-167114 A 7/2008
JP 2009-177552 A 8/2009
WO WO 98/53525 A1 11/1998
WO WO 2011/073844 A2 6/2011

OTHER PUBLICATIONS

International Search Report for PCT/EP2013/051692 dated May 3, 2013.

* cited by examiner

SUBREFLECTOR OF A DUAL-REFLECTOR ANTENNA

CROSS-REFERENCE

This application is based on French Patent Application No. 12,50,895 filed on Jan. 31, 2012, the disclosure of which is hereby incorporated by reference thereto in its entirety, and the priority of which is hereby claimed under 35 U.S.C. § 119.

BACKGROUND

The present invention pertains to a dual-reflector antenna, particularly a microwave antenna normally used for mobile telecommunications networks.

In order to create a more compact system, one utilizes dual-reflector antennas, in particular those of the Cassegrain type. The dual reflector comprises a primary concave reflector, most commonly parabolic, and a secondary convex reflector, of much lesser diameter, placed in the vicinity of the focus of the parabola on the same axis of revolution as the primary reflector. A feed device comprising a waveguide is located along the antenna's axis of symmetry, facing the subreflector. These antennas are so-called "deep dish" antennas with a low F/D ratio, less than or equal to 0.25. In this report, F is the focal distance of the reflector (the distance between the reflector's apex and its focus) and D is the reflector's diameter.

These antennas exhibit high spillover losses and decrease the antenna's front-to-back ratio. Overflow losses lead to environmental pollution through RF waves and must be limited to levels defined by standards. One customary solution is attaching to the periphery of the primary reflector a shroud which has the shape of a cylinder, whose diameter is close to that of the primary reflector and of suitable height, coated on the inside with an RF radiation absorbing layer. The use of an expensive absorbent shroud is necessary to cancel out the spillover effect.

Furthermore, for low frequencies below 23 GHz, the high diameter of the primary reflector increases the levels of the secondary lobes (masking effect).

SUMMARY

The purpose of the present invention is to propose a dual-reflector antenna whose radiation pattern is improved so as to meet the specifications of FCC and ETSI standards.

In particular, the proposed antenna exhibits smaller side lobes and a high front-to-back ratio.

A further purpose of the invention is to eliminate the costly absorbent shroud.

The object of the present invention is a subreflector of a double reflector antenna comprising

- a first extremity comprising an internal convex surface
- a second extremity adapted to be coupled with the extremity of a waveguide
- a body extending between the first extremity and the second extremity, comprising
  - a first dielectric part having a portion penetrating into the waveguide and a portion external to the waveguide, and
  - a second metallic part comprising
    - a first cylindrical portion contiguous with the first extremity of the subreflector and whose diameter is greater than the portion outside the waveguide of the first dielectric part, and

- a second cylindrical portion adjacent to the first cylindrical portion, extended by a conical portion that penetrates into the first dielectric part
    - a flat ring-shaped surface, supported by the first cylindrical portion, which forms a less-than-90° angle with the axis of the subreflector so as to face the primary reflector.

According to a first aspect, that less-than-90° angle is preferentially between 70° and 85°.

According to a second aspect, the flat ring-shaped surface is disposed within the outside cylindrical wall delimiting the first cylindrical portion.

According to a third aspect, the flat ring-shaped surface is placed at the junction of the first cylindrical portion and the second cylindrical portion.

According to a fourth aspect, the flat ring-shaped surface forms an angle 90° apart from the plane of the second cylindrical portion's cross-section.

According to a fifth aspect, the first dielectric part supports at least one ring-shaped groove. Preferentially, the first dielectric part comprises at least two ring-shaped grooves. Even more preferentially, the portion outside the waveguide of the first dielectric part includes at least one ring-shaped groove.

According to a sixth aspect, each of the cylindrical portions of the second metallic part includes at least one ring-shaped groove. Preferentially, each of the cylindrical portions of the second metallic part comprises at least two ring-shaped grooves.

According to one embodiment, the ring-shaped groove has a depth of between $\lambda/5$ and $\lambda/4$, where $\lambda$ is the wavelength of the central frequency of the antenna's working frequency band.

According to another embodiment, the ring-shaped groove has a width much less than $\lambda$, where $\lambda$ is the wavelength of the central frequency of the antenna's working frequency band.

According to yet another embodiment, the ring-shaped groove has a flat-bottomed U-shape profile.

According to a seventh aspect, the portion outside the waveguide of the first dielectric part has a diameter less than or equal to $2\lambda$, where $\lambda$ is the wavelength of the central frequency of the antenna's working frequency band.

According to an eighth aspect, the portion outside the waveguide belonging to the first dielectric part has a length on the order of the wavelength $\lambda$ of the central frequency of the antenna's working frequency band.

According to a ninth aspect, the second metallic part is made of a solid metal.

The main idea is to construct the subreflector from two parts in order to facilitate design and lower the cost of the dielectric material part. The part made of dielectric material, for example a plastic material such as "Rexolite", is small in size and has a special profile. This dielectric part connects the radiating waveguide and the metallic subreflector. The design of this dielectric part is a major aspect of the invention as it is not only part of the subreflector but adding some grooves to the edge of the dielectric part considerably improves the antenna's radiation pattern.

One advantage of the invention is providing a compact non-shrouded antenna with high performance. Furthermore, this antenna has a low-cost feed device, particularly for low frequencies. This is because the dimensions of the feed devices are proportional to the wavelength. The volumes of these devices grow larger at low frequencies. In particular, the diameter of the subreflector, normally made of dielectric material, is large, making the antenna expensive. In the present situation, the dielectric part, though still dependent on the wavelength, has a smaller volume, so it is less expensive. The part made of solid metal is aluminum, a material much less expensive than the dielectric material.

The invention applies to an antenna used for microwave links with radio-boxes that include all the antenna's active electronics and serve to make the radio link.

BRIEF DESCRIPTION

Figure 2:
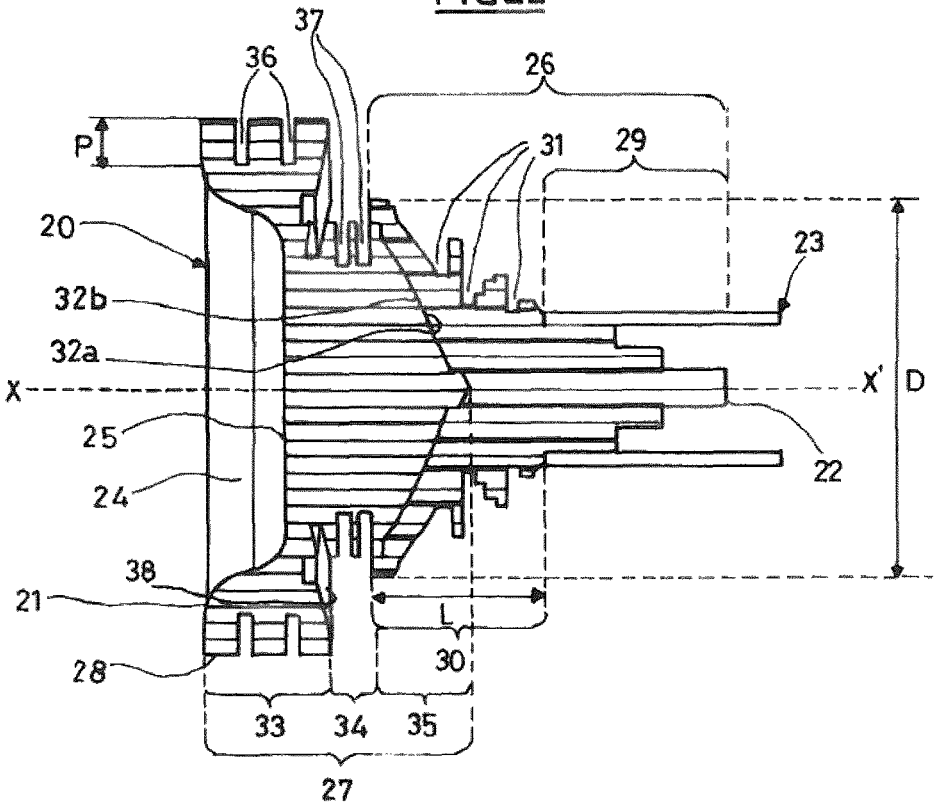
Figure 3:
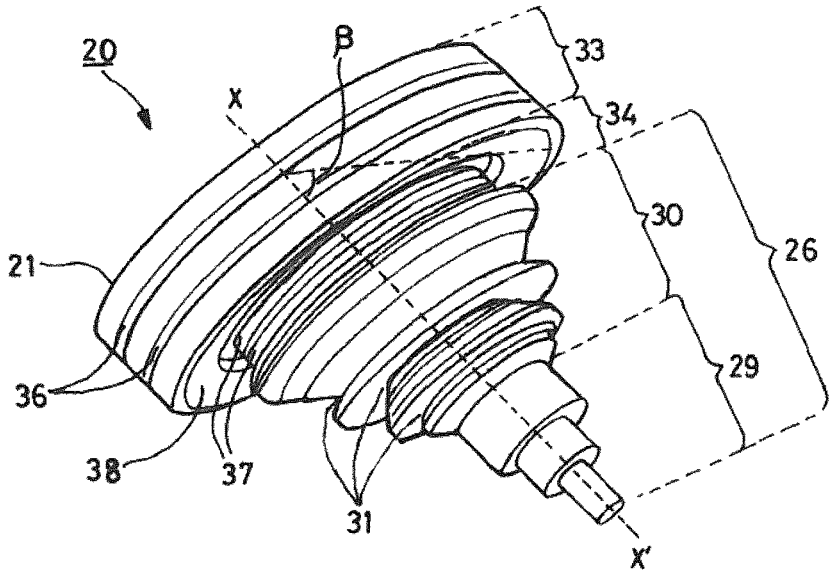
Figure 4:
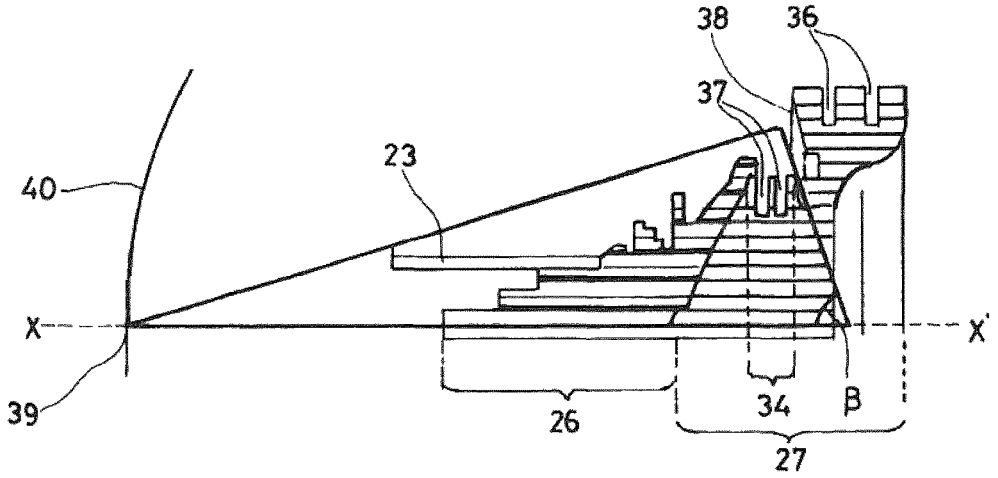
Figure 5:
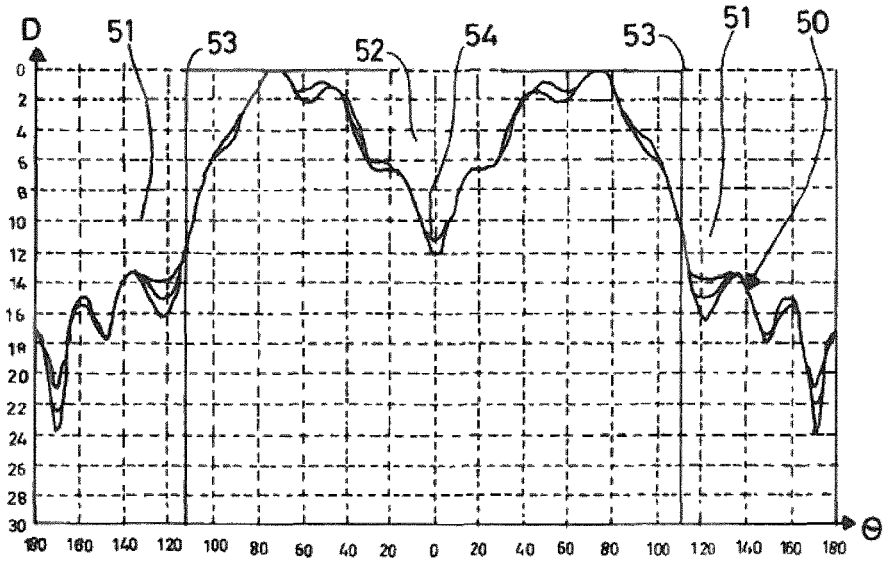
Figure 6:
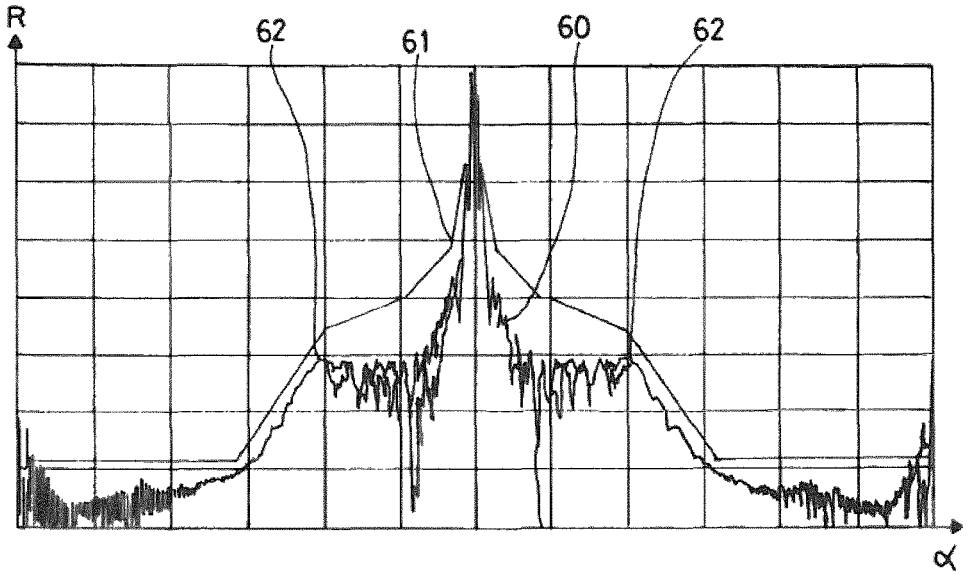
Figure 7:
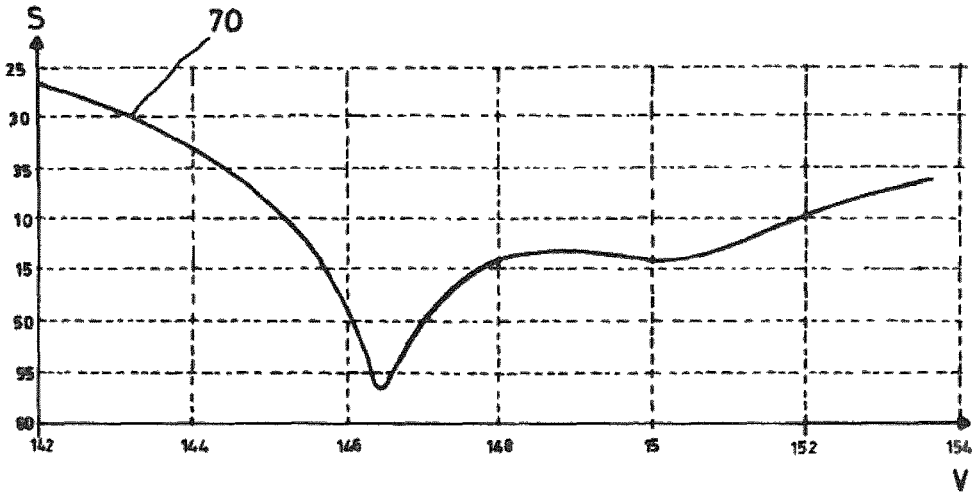

Other characteristics and advantages of the present invention will become apparent upon reading the following description of one embodiment, which is naturally given by way of a non-limiting example, and in the attached drawing, in which:

FIG. 1 schematically illustrates a cross-section of a known dual-reflector antenna FIG. 2 illustrates a cross-section of one embodiment of a subreflector FIG. 3 illustrates a rear perspective view of one embodiment of a subreflector FIG. 4 illustrates a detailed view of part of the subreflector of FIGS. 2 and 3, FIG. 5 illustrates the radiation pattern of the primary reflector in the 15 GHz frequency band depending on the angle of reflection measured in comparison to the axis of the parabola FIG. 6 illustrates the radiation pattern in the 15 GHz frequency band in the horizontal plane of an antenna depending on the transmission/reception angle FIG. 7 illustrates the reflection losses in the 15 GHz frequency band depending on the frequency Identical elements in each of these figures have the same reference numbers.

DETAILED DESCRIPTION

FIG. 1 illustrates an antenna 1 of a known type with a deep-dish reflector and low focal distance, comprising a primary reflector 2 and a subreflector 3. The antenna 1 is fed by a waveguide 4 which may be a hollow metal tube, for example one made of aluminum. The reflectors 2, 3 are protected by a radome 5. The subreflector 3 comprises a first extremity 6 with a lower radius making the junction with the waveguide 4 and one large-radius open extremity 7, where a convex inner surface 8, which reflects RF signals, meets an outer surface 9 that connects the two ends 6, 7. The outer surface 9 of the subreflector 3 is the surface facing the primary reflector 2. The inner surface 8 and the outer surface 9 are surfaces revolving around a single axis of revolution. A dielectric body 10 extends between the first and second ends 6, 7, limited by the inner surface 8 and the outer surface 9. Part 11 of the material of the dielectric body 10 extends to penetrate into the waveguide 4, in order to ensure mechanical stability and radio transition between the waveguide 4 and the subreflector 3.

The waveguide 4 emits incident radiation in the direction of the subreflector 3 which is reflected towards the primary reflector 2, forming the main beam 12 towards the receiver. However, part of the incident radiation is sent back in a divergent direction and causes overflow losses 13. Another part of the radiation is reflected by the primary reflector 2, but this reflected radiation is masked by the subreflector 3 which sends it back to the primary reflector 2. It is then reflected by the primary reflector 2 and sent back in a divergent direction, causing losses due to the masking effect 14.

In the embodiment depicted in FIGS. 2 and 3, the subreflector 20 comprises a first extremity 21 and a second extremity 22 adapted to couple it to the extremity of a waveguide 23. A convex inner surface 24 is built into the first extremity 21 having an axis of revolution that is the axis X-X' of the reflector 20. A body 25 extends between the first extremity 21 and the second extremity 22. That body 25 is made up of two parts: a first part 26 made of dielectric material, which is at least partially inserted into the waveguide 23 and provides the link between the subreflector 20 and the waveguide 23, and a second metallic part 27, extending the first dielectric part 26, having a reflective surface 28.

The first dielectric part 26, approximately conical in shape, has a greater diameter D, which is less than that of the second metallic part 27. A significant decrease in the cost of the dielectric material is achieved thanks to the first dielectric part 26 having a lesser volume, about 25% less in this case, compared to the prior known solution. The dielectric material that is used is "Rexolite", chosen for its low, stable dielectric constant, but nonetheless high cost. The portion 29 of the first dielectric part 26 that is within the waveguide 23 is conventional in design and makes it possible to improve the transition of the signal between the guided mode inside the waveguide 23 and the signal outside the waveguide 23. The portion 30 of the first dielectric part 26 that is outside the waveguide 23 has a maximum diameter D of $2\lambda$, hence $\lambda$ is the wavelength of the central frequency of the antenna's operating band, and a length L of about $\lambda$. The outer surface of the portion 30 of the first dielectric part 26, which is generally conical, includes three grooves 31, in order to achieve improved return loss and better performance by the radiation pattern.

The extremity of the first dielectric part 26 opposite the waveguide 23, which is the cone's base, is affixed to the second metallic part 27 of the subreflector 20. The second part 27 is made up of a solid metal, e.g. aluminum. The surface 32*a* opposite the waveguide 23, of the first dielectric part 26, is in contact with a portion 32*b* of the reflective surface 28 of the subreflector 20, and it is of the same shape. The profile of the portion 32*b* of the reflective surface 28 du subreflector 20 has been optimized by a polynomial equation. The purpose of the reflective surface 28 of the subreflector 20 is to focus onto the primary reflector all the power from the waveguide 23 with minimal overflow losses.

The second metallic part 27 of the subreflector 20 has a shape comprising two adjacent cylindrical portions 33 and 34 ending in a conical portion 35 penetrating into the first dielectric part 26. In the larger-diameter first cylindrical portion 33 contiguous with the first extremity 21 of the subreflector 20, at least one groove 36 has been built into the cylinder's surface. In the smaller-diameter second cylindrical portion 34, at least one groove 37 has been built into the cylinder's surface. In the present situation, each of the cylindrical portions 33, 34 features two grooves 36, 37 having a flat-bottomed U-shaped profile and the form of a ring centered on the X-X' axis of the reflector 20. The depth P of the grooves 36, 37 is between $\lambda/5$ and $\lambda/4$, and its width is very small compared to the wavelength $\lambda$ of the central frequency of the antenna's working frequency band.

In the vicinity of its junction with the smaller-diameter second cylindrical portion 34, the smaller-diameter first cylindrical portion 33 features a flat ring-shaped surface 38 that faces the primary reflector. This flat ring 38 is disposed within the outer cylindrical wall bounding the first cylindrical portion 33 as shown in greater detail in FIG. 4. The flat ring 38 has a flat surface that forms a $\beta$ angle with the X-X' axis of the subreflector 20, 90° apart. This angle β is preferably less than 90°, and preferably still between 70° and 85°. The flat ring 38 also forms an angle 90° apart from the plane of the cross-section of the second cylindrical portion 34. This angle is calculated so as to reflect the signal towards the center 39 of the parabolic primary reflector 40. The presence of that flat ring 38 turned towards the primary reflector is essential to keep the radiation from being directed towards the edges of the parabola, thereby causing overflow losses 13. It is also possible to have, in the center of the primary reflector 40, either an absorbent material in order to capture that part of the undesirable radiation, or a geometrically appropriate means to trap the undesirable radiation, or a means may be placed there that can quickly send the undesirable radiation back into the main radiation beam.

The described shapes and their dimensions make it possible to achieve very high-level radio performance, as shown in the radiation pattern of the antenna's primary reflector shown in FIG. 5. On the graph 50 in FIG. 5, the radiation's intensity I in dB within the 15 GHz frequency band is given on the y-axis, and the angle of reflection η in degrees is given on the x-axis. The angle of reflection θ is measured compared to the parabola's axis (θ=0°). The values −θ et +θ delimit overflow loss zones 51 on either side, and between those two values, a masking effect zone 52 centered on the axis of the parabolic primary reflector. The overflow loss areas 42 correspond to a reflection angle above 100°. In the present situation, it is observed that those overflow losses are low, on the order of −12 dB at the edges of the primary reflector 53.

The radiation pattern of the primary reflector depicted by the curve 50 is excellent: the surface of the subreflector alone is illuminated, which considerably reduces the overflow losses 51, and a low field value 54 in the center of the primary reflector makes it possible to reduce the masking effect 52. The masking effect occurs when waves, after being reflected against the main reflector, return to the subreflector (see FIG. 1). The end result is a high gain, a low intensity for the secondary loves, and a low field level on the antenna's edge. This last point makes it possible to obtain an antenna that meets ETSI's class 3 specification, without needed to have an absorbent shroud, and a low return loss value. Consequently, the antenna costs less and is more compact.

In FIG. 6, the graph 60 depicts the radiation pattern of the primary reflector in the horizontal plane. The intensity I of the radiation R in dB in the 15 GHz frequency band is given in the y-axis and the angle of transmission/reception α in degrees is given in the x-axis. The reference graph 61 represents the standard profile (ETSI) and the areas 62 correspond to the side lobes. The values of the radiation pattern remain within the maximum values allows by the ETSI class 3 specification.

FIG. 7 illustrates the return loss of a subreflector in the 15 GHz frequency band based on the frequency of the wave transmitted or received. The intensity of the parameter [S] in dB is given in the y-axis and the frequency ν in GHz is given in the x-axis. A return loss below −35 dB is observed on the majority of the curve 70. A low return loss value is therefore observed on a large part of the frequency band.

Naturally, the present invention is not limited to the described embodiments, but is, rather, subject to many variants accessible to the person skilled in the art without departing from the spirit of the invention. In particular, it is possible to use other materials besides those described here to construct the metal and dielectric parts of the subreflector.

There is claimed:

1. A subreflector of a dual-reflector antenna comprising:

a first extremity comprising an internal convex surface;

a second extremity adapted to be coupled with the extremity of a waveguide; and a body extending between the first extremity and the second extremity, comprising a first dielectric part having a portion penetrating into the waveguide and a portion external to the waveguide, and a second part comprising a first cylindrical portion contiguous to the first extremity of the subreflector whose diameter is greater than the portion outside the waveguide of the first dielectric part;

wherein the second part is metallic and further comprises:

a second cylindrical portion adjacent to the first cylindrical portion, extended by a conical portion that penetrates into the first dielectric part;

a flat ring-shaped surface, supported by the first cylindrical portion, which forms a less-than-90° angle with the axis (X-X') of the subreflector calculated so as to reflect the signal towards the center of the primary reflector; and wherein the flat ring-shaped surface:

is disposed within the outer cylindrical wall delimiting the first cylindrical portion; and faces the primary reflector.

2. A subreflector according to claim 1, wherein the angle is between 70° and 85°.

3. A subreflector according to claim 1, wherein the flat ring shaped surface is placed at the junction of the first cylindrical portion and the second cylindrical portion.

4. A subreflector according to claim 1, wherein the flat ring-shaped surface forms an angle 90° apart from the plane of the cross-section of the second cylindrical portion.

5. A subreflector according to claim 1, wherein the first dielectric part features at least one ring-shaped groove.

6. A subreflector according to claim 5, wherein the ring-shaped groove has a depth of between λ/5 and λ/4, where λ is the wavelength of the central frequency of the antenna's working frequency band.

7. A subreflector according to claim 5, wherein the ring-shaped groove has a width less than λ, where λ is the wavelength of the central frequency of the antenna's working frequency band.

8. A subreflector according to claim 5, wherein the ring-shaped groove has a flat-bottomed U-shaped profile.

9. A subreflector according to claim 1, wherein each of the cylindrical portions of the second metallic part features comprise at least one ring-shaped groove.

10. A subreflector according to claim 9, wherein each of the cylindrical portions of the second metallic part comprise at least two ring-shaped grooves.

11. A subreflector according to claim 1, wherein the portion outside the waveguide of the first dielectric part has a diameter greater than or equal to 2λ, where λ is the wavelength of the central frequency of the antenna's working frequency band.

12. A subreflector according to claim 1, wherein the portion outside the waveguide of the first dielectric part has a length on the order of the wavelength of the central frequency of the antenna's working frequency band.

13. A subreflector according to claim 1, wherein the second metallic part is made up of solid metal.

* * * * *